US006554694B2

(12) United States Patent
Umeda et al.

(10) Patent No.: US 6,554,694 B2
(45) Date of Patent: Apr. 29, 2003

(54) ESCALATOR EQUIPMENT FOR COINS

(75) Inventors: Masayoshi Umeda, Iwatsuki (JP); Hiroshi Abe, Iwatsuki (JP)

(73) Assignee: Asahi Seiki Kabushiki Kaisha (JP)

( * ) Notice: Subject to any disclaimer, the term of this patent is extended or adjusted under 35 U.S.C. 154(b) by 88 days.

(21) Appl. No.: 09/733,561

(22) Filed: Dec. 8, 2000

(65) Prior Publication Data

US 2001/0004582 A1 Jun. 21, 2001

(30) Foreign Application Priority Data

Dec. 9, 1999 (JP) ..... 11-376404

(51) Int. Cl.[7] ..... G07D 1/00
(52) U.S. Cl. ..... 453/56
(58) Field of Search ..... 453/56, 63; 198/443, 198/456, 779, 788; 194/342, 343, 344

(56) References Cited

FOREIGN PATENT DOCUMENTS

JP 7-14046 1/1995

*Primary Examiner*—Donald P. Walsh
*Assistant Examiner*—Mark J Beauchaine
(74) *Attorney, Agent, or Firm*—McGlew and Tuttle, P.C.

(57) ABSTRACT

A miniaturizes lifting style coin hopper is provided with a coin escalator device. The lifting style hopper equipment uses a small hopper with improved escalator equipment. The escalator equipment for coins includes a back plate with a curved surface for carrying a plurality of coins which are arranged in a single plane row from bottom to top. A pair of spacers are placed at each side on the upper surface of this back plate, respectively. The escalator equipment for coins has at least a plurality of idlers which are freely rotatably arranged, covering the back plate between the paired spacers. A spring device presses these idlers to the back plate.

9 Claims, 9 Drawing Sheets

ESCALATOR EQUIPMENT FOR COINS

FIELD OF THE INVENTION

This invention relates to coin escalator equipment, which pushes up coins one by one and pays out the coins one by one from the upper part thereof. Especially, this invention concerns an escalator device for pushing up and paying out coins, stored in a bulk condition, one by one, from the upper part thereof This invention is used for a lifting style hopper device, for coins and medals, tokens which are used for game machines, including a slot machine etc. The terminology "coin" used in this specification generally refers to small disk bodies which are distributed as currency. The terminology "coin" in this specification also is intended to encompass medals, tokens and other small disk body, which are used in games and the like.

BACKGROUND OF THE INVENTION

Equipment for raising the position of coins and paying one by one at the elevated position has been provided as various developed products. Japanese Patent Application 2-417960 by the present applicant, discloses a coin-lifting type hopper device. Japanese Patent Application 2-417960 is published and granted with Japanese Patent Publication 7-92847. In the U.S.A., this Japanese Patent Application 2-417960 is granted as U.S. Pat. No. 5,170,874. Lifting style coin hopper equipment which is disclosed on these public information is summarily shown on perspective view of FIG. 9.

The hopper equipment shown in FIG. 9 has a tank 1 like a pot shape for storing a plurality of coins A in a bulk condition. This hopper equipment has an outlet 5 for releasing coins A in tank 1 to the outside of this tank 1. This equipment has a rotating disk 2 for driving away coins A in the tank 1 to outlet 5 one by one. This rotating disk 2 has a circular mount division 3 on the center thereof and is provided with a plurality of pins 4 on the circumference thereof When the rotating disk 2 is rotated in counterclockwise, coin A is driven away to outlet 5 by pins 4 and mount division 3. In other words, when rotating disk 2 is rotated, coin A is driven away to outlet 5 one by one, intervening a knife. In addition, a long escalator equipment 6 is stood up on this hopper equipment, for raising coins A from outlet 5. Reference numeral 8 in FIG. 9 is a long back plate, and numeral 12 designates taper rollers.

On the long center line division of back plate 8, alley way 10 for coins A is formed by a plurality of rollers 12.

A problem was detected that the installation space for the lifting style coin hopper was undesirably large. That is to say, the above-mentioned lifting style coin hopper equipment used a large tank 1 with rotating disk 2 which was in an oblique standing condition. In addition, the bending at bend 6*c* of escalator equipment 6 had to be loosened for smoothly pushing up of the coins. As this result, conventional lifting style coin hopper equipment had to be enlarged.

SUMMARY AND OBJECTS OF THE INVENTION

This invention was developed in order to miniaturize the lifting style coin hopper equipment. In other words, the purpose of this invention is to offer a lifting style coin hopper device using a small hopper.

An object of this invention is to offer a lifting style coin hopper using a small hopper, which has a level rotating disk, for example.

Further, the purpose of this invention is to offer a small lifting style coin hopper which has improved escalator equipment.

According to this invention an escalator device for coins comprises a back plate with a curved surface for carrying from bottom to top a plurality of coins which are arranged in a single plane row. A pair of spacers are placed at each side on upper surface of this back plate, respectively. The escalator device for coins comprises at least a plurality of idlers which are freely rotatably arranged, covering the back plate between the paired spacers. A spring device presses these idlers to the back plate.

Also, this invention includes an escalator device for coins, wherein an endless belt is stretched on the plurality of idlers.

Also, this invention provides an escalator device for coins, wherein the spring device has arms.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
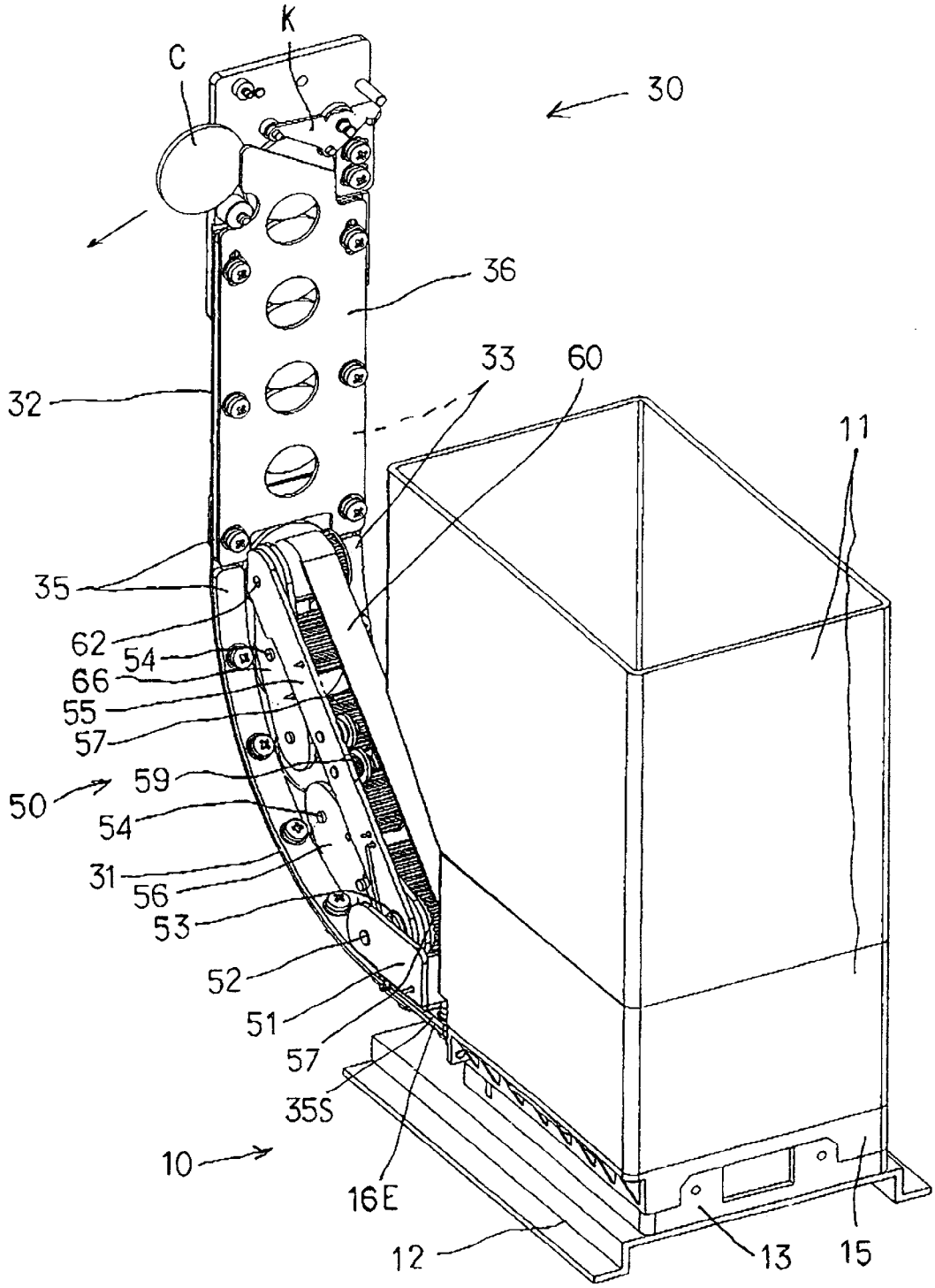
FIG. 1 is a perspective view in which an embodiment according to this invention is summarily showed.
Figure 2:
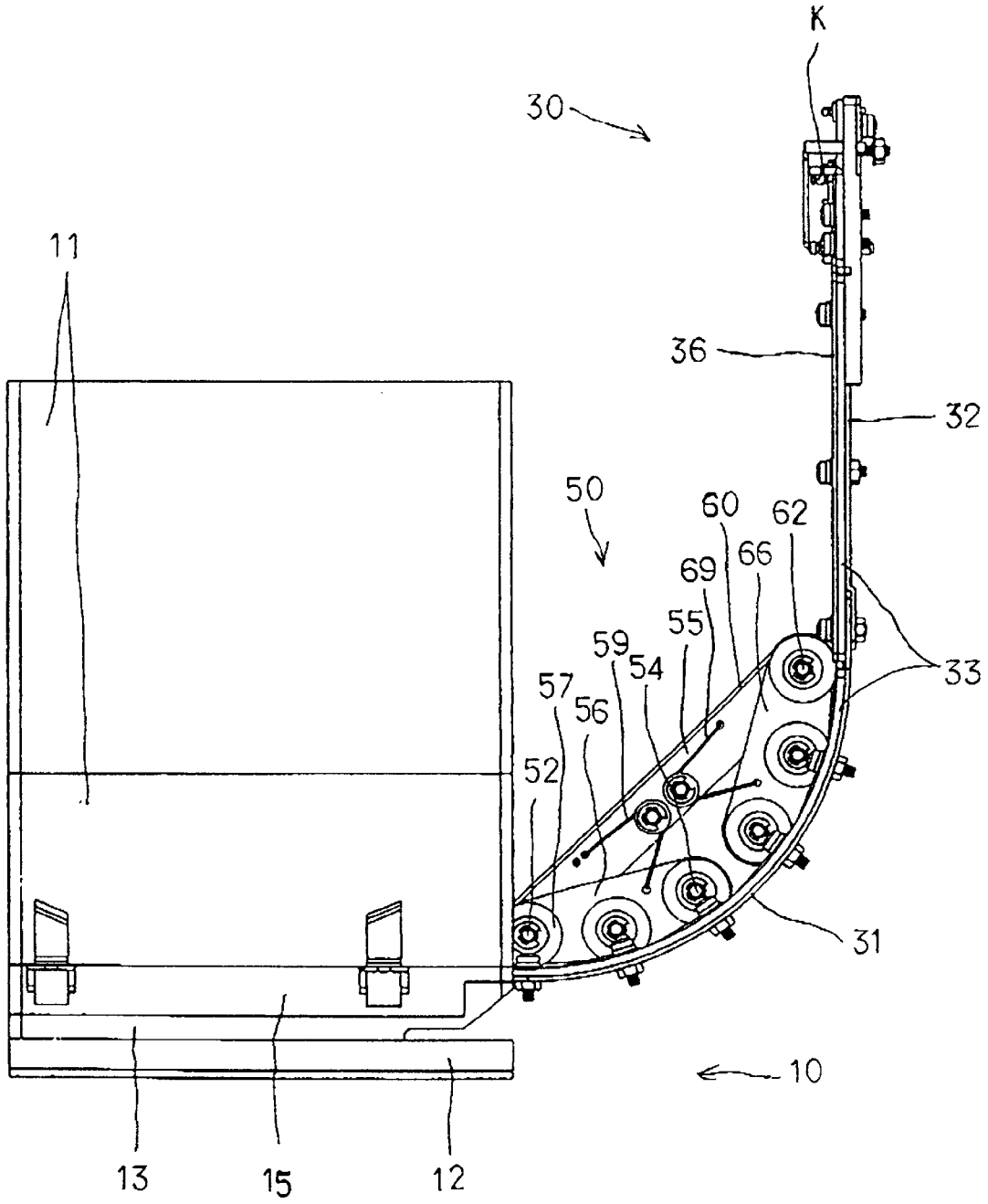
FIG. 2 is a summary side-view in which the practical example of FIG. 1 is observed from the right side.
Figure 3:
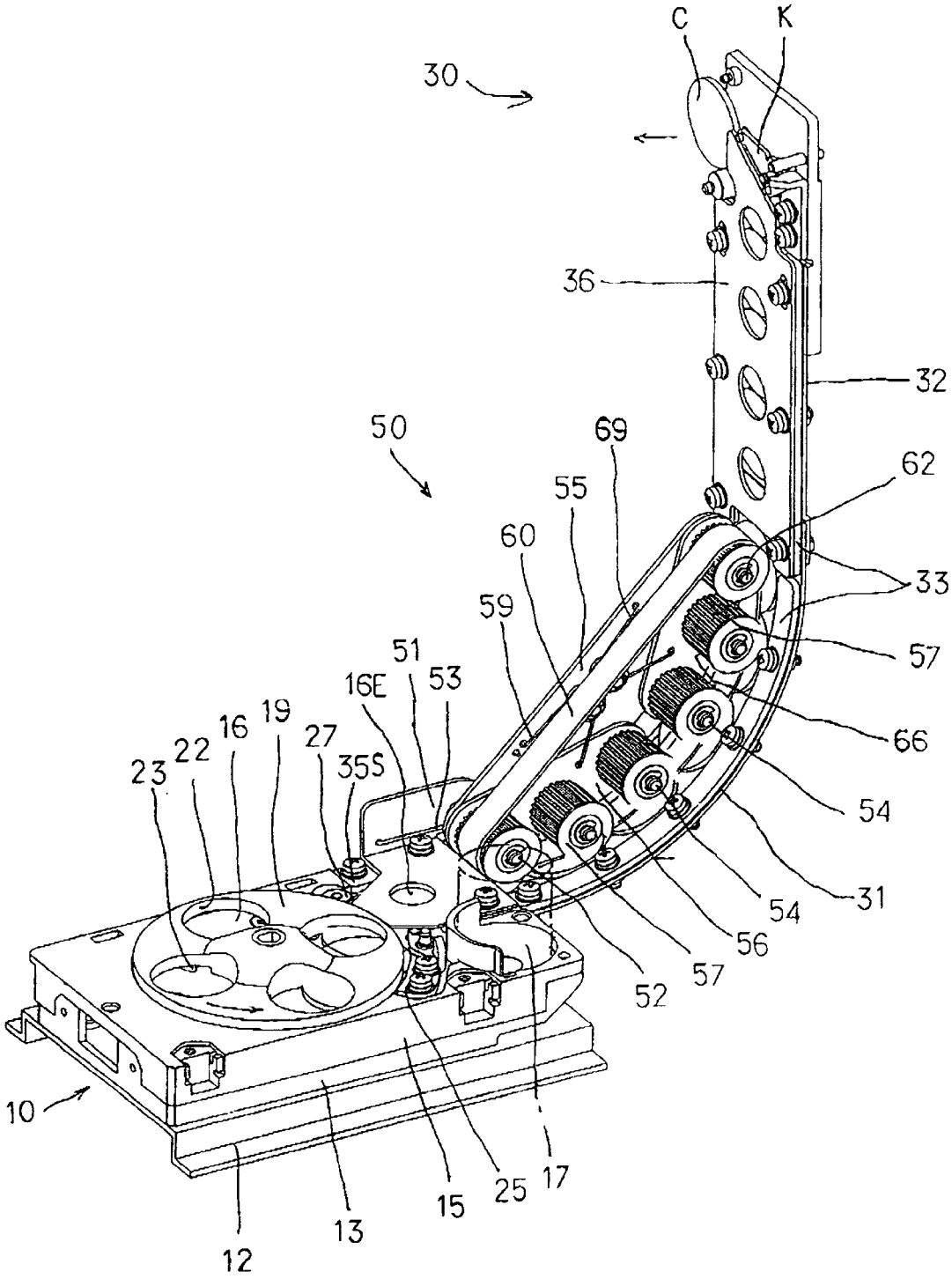
FIG. 3 is a perspective view in which the main section in FIG. 2 is summarily shown.

Referring to the drawings in particular, the hopper device includes a large upright box 11 which is shown at right side in FIG. 1. This is a coin tank for the hopper device. In this tank 11, a lot of coins are stored in a bulk condition. The tank 11 is a molded resin article, and it is formed in a generally angle barrel shape. A perspective view in which angle barrel tank 11 is removed is shown in FIG. 3. A flat box type hopper device 10 which is shown at the left lower in FIG. 3 is fixed on a rectangle tabular base mount 12. The hopper device 10 has a separable bottom plate 13, a resin molded article, and a base board 15, a resin-molded article, which covers thereon. On the indent at the upper portion on base board 15, a metallic plate 16 for coin sliding is fixed. The tip portion is formed as an outlet 16E of hopper device 10 (see FIG. 5).

At the tip division on the flat box type hopper device 10, an electric motor 17 is provided in a standing up state (see FIG. 3). The rotating shaft of the electric motor 17 is directed downward. The rotating shaft, which is located at the position under electric motor 17, is fixed to a primary gear (not shown). At the upper surface central of metal plate board 16, a disk 19 is freely rotatably arranged.

This disk 19 has a plurality of open holes 22 which are used in order to dispense coins one by one. Then, on the lower part of rotating shaft of disk 19, a second gear (not shown) for rotating this disk 19 is fixed. In addition, in hopper device 10, there is a gear train (not shown) for coupling the primary gear with the second gear. The primary gear and second gear and gear train are installed in hopper device 10 at the position under disk 19. The electric motor 17 is placed on the width side of disk 19 (see FIG. 3).

In the above-mentioned hopper device 10, when electric motor 17 is driven, the disk 19 is rotated in the counter-clockwise direction via the intervening gear group. When the disk 19 is rotated, the coins will push one coin piece out at the outlet 16E of metal plate 16. That is to say, when the electric motor 17 is driven, the coins in tank 11 fit into open holes 22 of rotated disk 19. The most bottom coins which fit into open holes 22 slide on metal plate 16 by nails 23 under disk 19. The most bottom coins in the open holes 22 slide on metal plate 16 by the rotation of disk 19.

The sliding coins on the metal plate 16 are guided in the outlet 16E direction. The coins are guided to the outlet 16E direction by base board 15 which surrounds the margin of disk 19 and a guide piece 25. The coins which are guided to the outlet 16E direction are dispensed outside from open holes 22 by means of nails 23 and paired pins (not shown).

The coins which are pushed out outside are more extruded outside by nails 23, resisting the springs of paired rollers 27 (a part shown). The coin which is pushed out outside is located at outlet 16E, and it is further pushed out by next pushed coin.

In this way, the coins which are pushed out from outlet 16E one by one are dispensed into an escalator device 30, becoming an even single row.

The escalator device 30 has an upstanding J-type body which is shown at the right side in FIG. 3. As shown on the drawing, escalator device 30 has a flat back plate 32 on the upper part of curved back plate 31. On each side of bent back plate 31 and standing back plate 32, slender spacers 33 and 35 are fixed, respectively. Between paired spacers 33 and 35 on bent back plate 31, belt device 50 is arranged.

Figure 5:
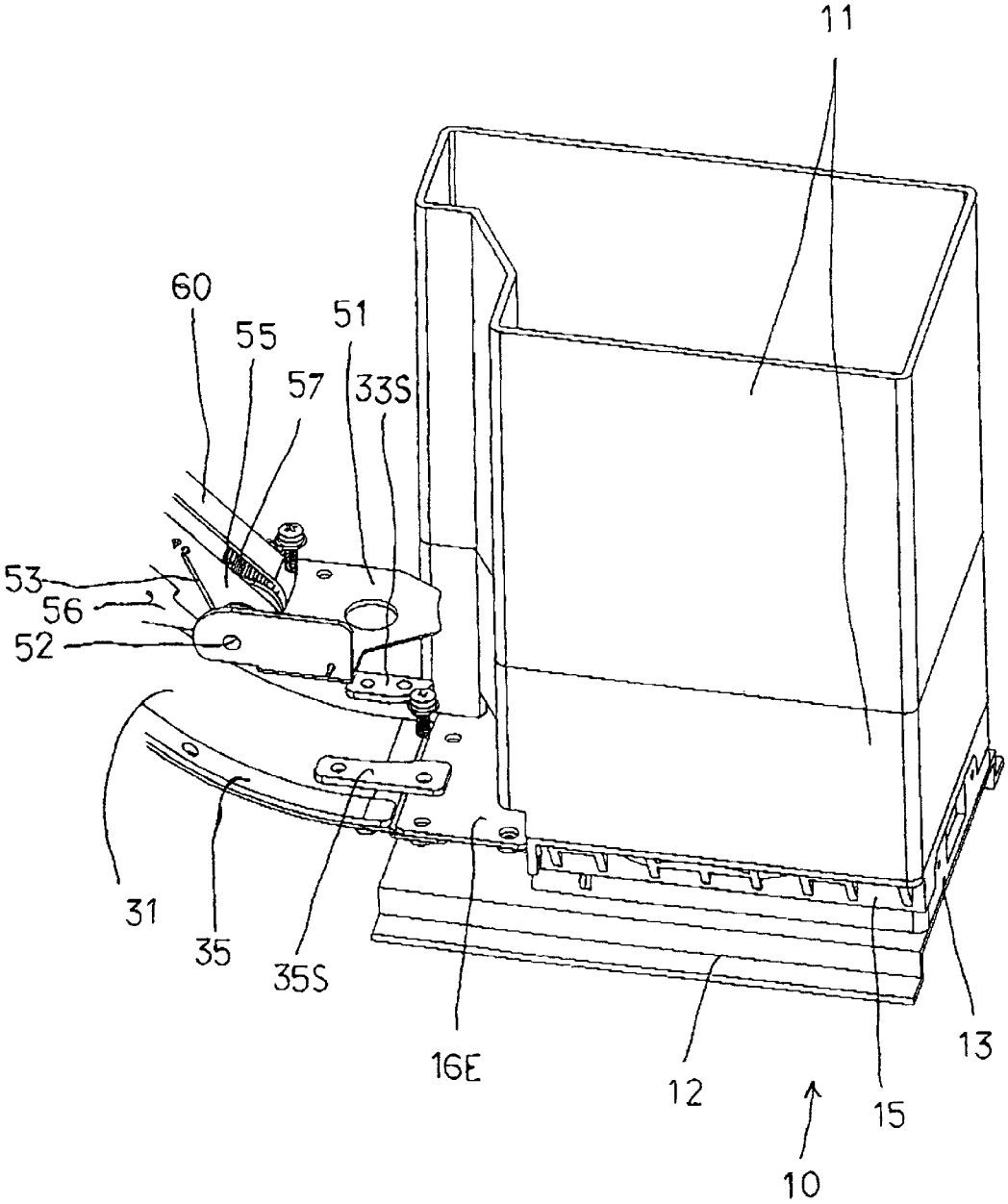
FIG. 5 is a summary partially exploded perspective view for explaining the mounting division in FIG. 1.

Belt device 50 has a mounting board 51 which is formed in a summary L shape (see FIG. 5). On the standing piece of mounting board 51, a pivot shaft 52 is installed sideways. On this pivot shaft 52, a large coiled spring 53 is covered (see FIG. 1). In addition, base end of a long or support arm 55 is freely rotatably covered on pivot shaft 52. An end of coiled spring 53 is hooked on mounting board 51, and the other end thereof is caught on long arm 55. Therefore, long arm 55 is pressed to back plate 31 direction, around pivot shaft 52. In addition, base end of short or contact arm 56 is freely rotatably covered on pivot shaft 52. An idler 57 also is freely rotatably covered on this pivot shaft 52 (see FIG. 3). On the tip and central parts of short or contact arm 56, pivot shafts 54 also are installed sideways, respectively.

Then, each idler 57 is freely rotatably covered on each pivot shaft 54, respectively. On the central of long arm 55, a little small coiled spring 59 is arranged. An end of this coiled spring 59 is caught on long arm 55, and the other end thereof is hooked on short arm 56. Therefore, the short arm 56 is pressed on back plate 31, around pivot shaft 52.

Similarly, on the tip of long arm 55, a pivot shaft 62 is installed sideways. On pivot shaft 62, a short or contact arm 66 is also freely rotatably covered. Similarly, idler 57 is freely also rotatably covered on this pivot shaft 62. On the tip and central parts of short arm 66, pivot shafts 54 are installed sideways also, respectively. Each idler 57 is also freely rotatably covered on each pivot shaft 54. In addition, on the central of long arm 55, a little small coiled spring 69 is arranged. An end of this coiled spring 69 is hooked on long arm 55, and the other end thereof is caught on short arm 66. Therefore, the little short arm 66 also is pressed on back plate 31, around pivot shaft 62.

A large ring type belt 60 is stretched on idlers 57, of which there is a total of six. Thus, the six idlers 57 group will press belt 60 on back plate 31. The coiled spring 53 and paired coiled springs 59 and 69 operate, respectively, and belt 60 is pressed on back plate 31. On the other hand, on flat back plate 32, forming part of the escalator device 30, a rectangle cover board 36 is arranged. The rectangle cover board 36 is bridged on paired spacers 33 and 35 of back plate 32. The coiled springs 53 and 59 and 69 and arms 55 and 56 and 66, etc. constitute a spring device.

The case in which escalator device 30 is installed on hopper device 10 which consists of above-mentioned composition is generally explained here.

Figure 4:
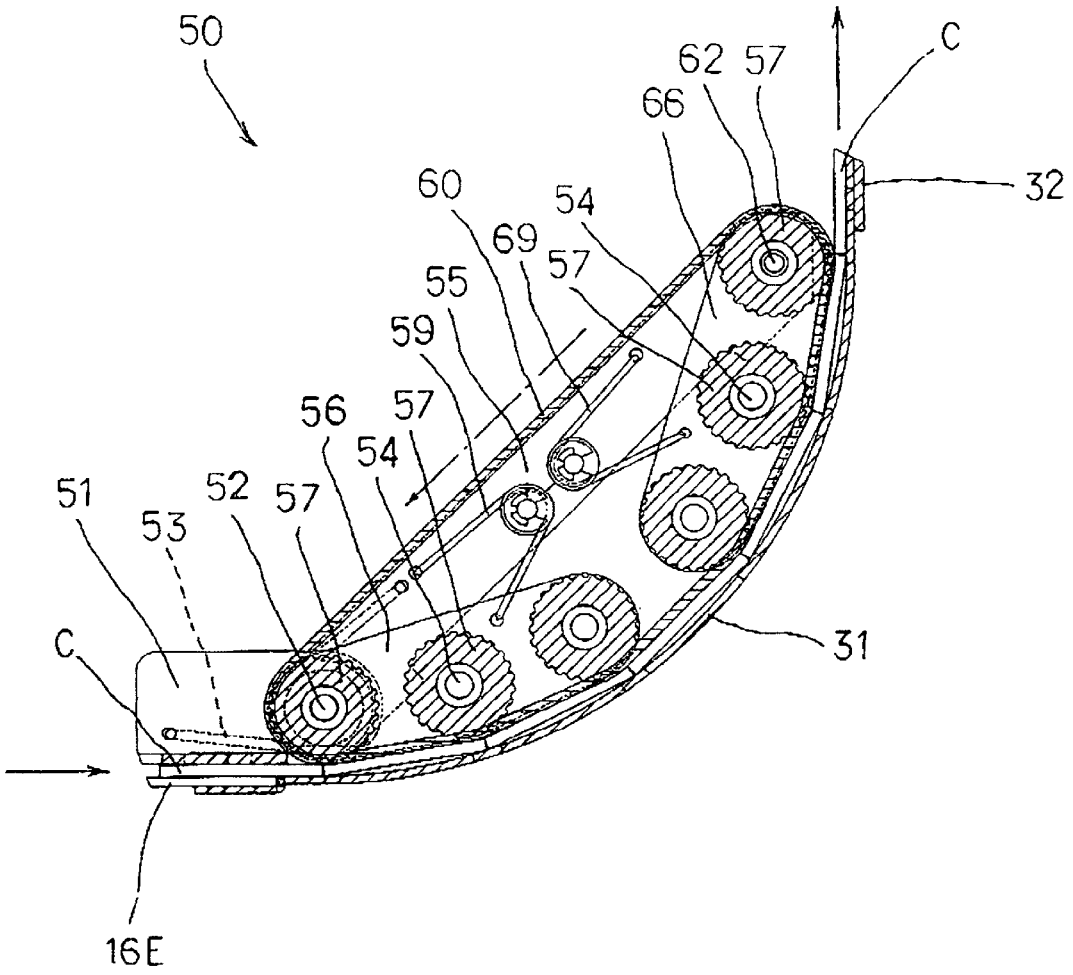
FIG. 4 is an enlarged section view in which the main portion of FIG. 3 is summarily shown.

To begin with, the lower end division of bent backplate 31 on escalator device 30 is inserted in, under the outlet 16E of hopper device of 10 (see FIG. 5). Next, intervening short paired spacers 33S and 35S, mounting piece 51 on belt device 50, are positioned at outlet 16E. A plurality of small bolts-nuts, back plate 31 and mounting piece 51 are fixed at the metallic outlet 16E (see FIG. 3). As this.result, the coin which is pushed out from hopper device 10 slides into on upper surface of back plate 31, passing to the outlet 16E (see FIG. 4). In this way, the coin C which is pushed out on the upper surface of curved back plate 31 is pushed and lifted by next pushed-out coin C. Then, the flat single row of coins C which are pushed and lifted up on back plate 31 are pressed on back plate 31 by endless belt 60. The intervening belt 60, presses the coins C on the back plate 31 by means of coiled springs 53 and 59 and 69. In this way, coins C which are pushed up in the condition of plane single row are finally released from the upper part of escalator device 30 to the outside. The coin C which has reached to the upper part of escalator device 30 is released by means of the spring (not shown) of kicker K. Since belt 60 becomes transfer-free by the group of idlers 57, rise-transfer of coins C is smoothly carried out. When unidirectional clutches and so on are provided within the group of idlers 57, the downward transfer of lifted coins C group is prevented.

If the belt 60 is omitted, when the diameter of coin C and the diameter of idlers 57 are considered. Though the illustration is omitted, it is of course possible for idlers 57 to be driven and compulsorily rotated by an electric motor. Although the main body of hopper device 10 is explained as a level condition (see FIG. 3), it is of course possible that the main body thereof may be inclined. That is to say, it is of course possible that the whole hopper device 10 is tilted in order to loosen the curvature of back plate 31. In other words, it is of course possible to use small hopper of which disk 19 may be tilted.

Figure 6:
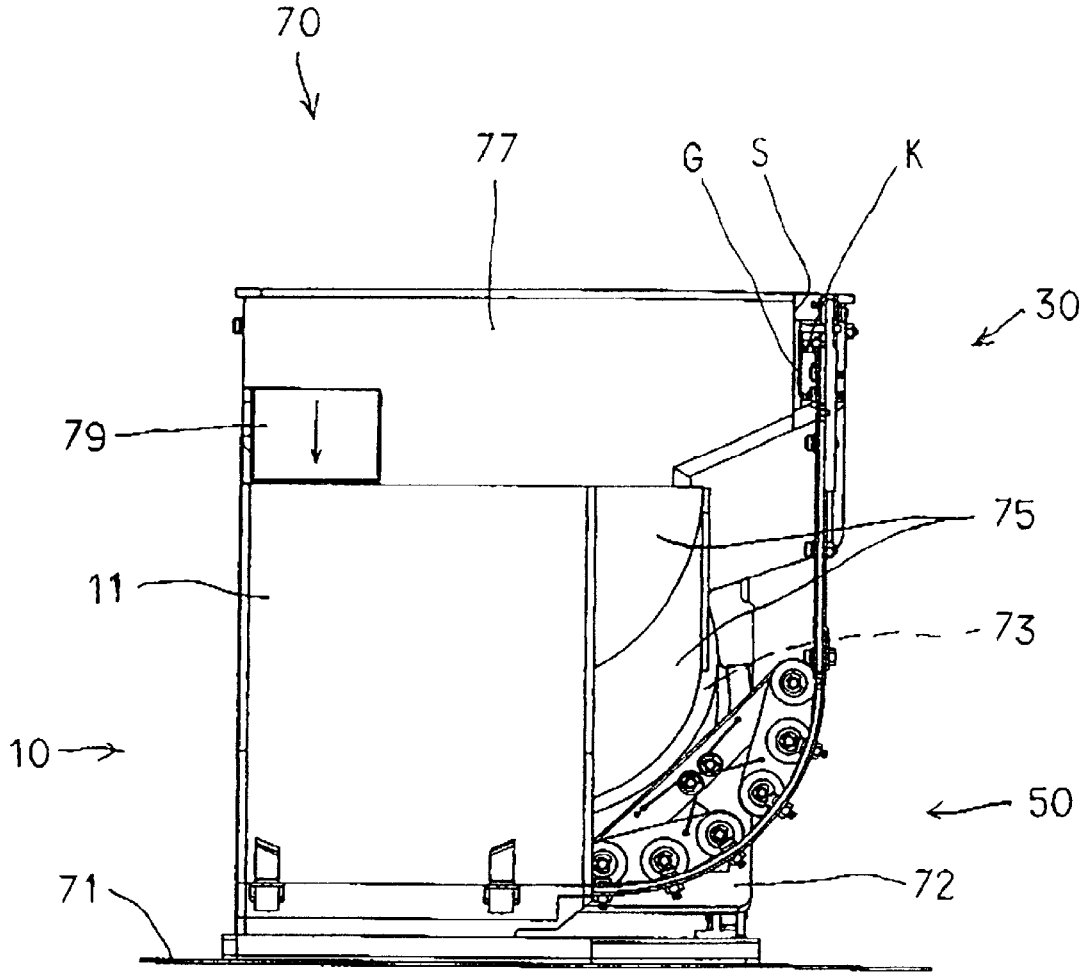
FIG. 6 is a front elevation view in which the use condition of the practical example according to this invention is summarily shown.
Figure 9:
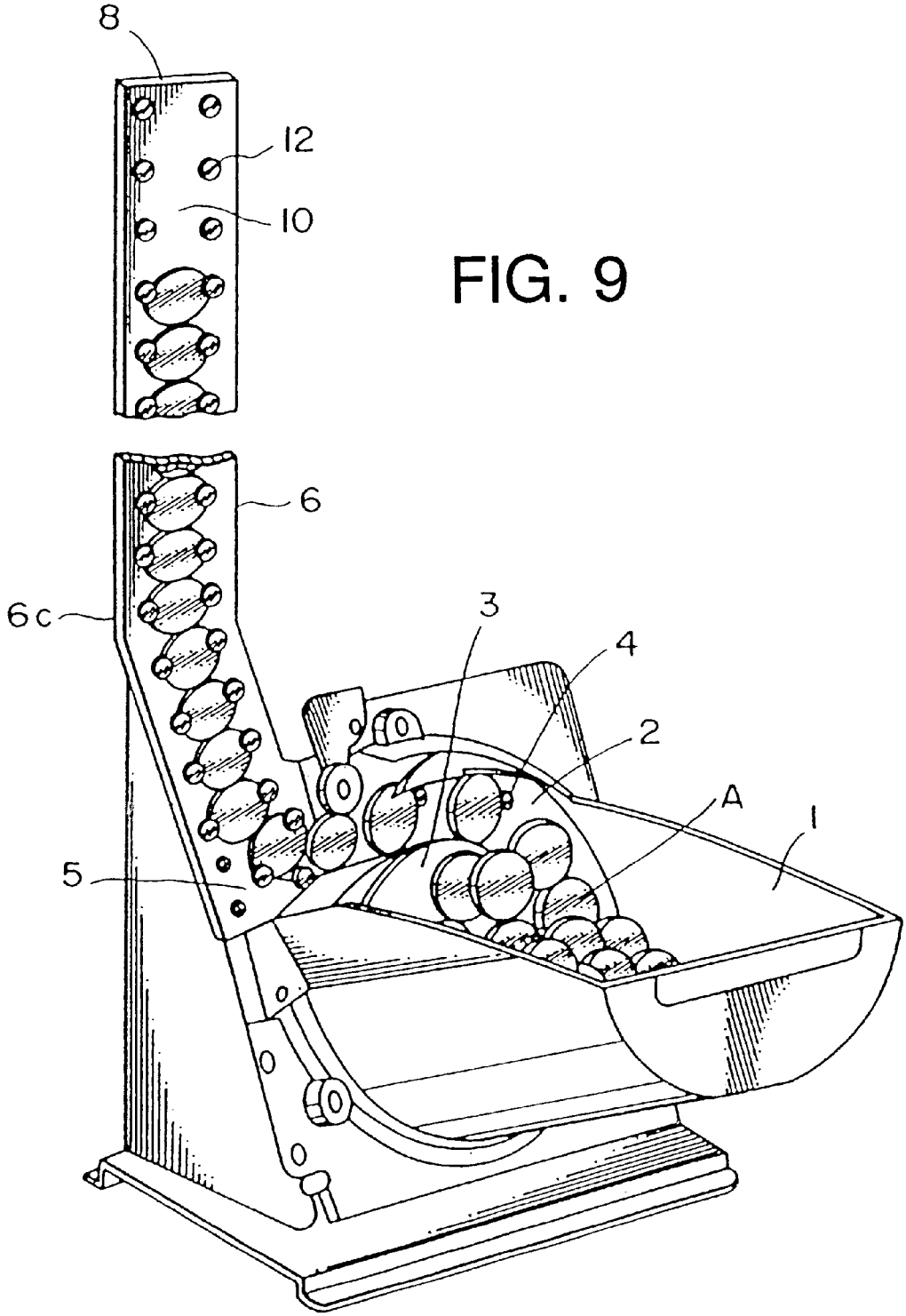
FIG. 9 is a summary perspective view which shows a prior art device.

Further, the use of a further example of a lifting-type small coin hopper device which has the above-mentioned constituents is generally explained here. FIG. 6 is a front elevation view in which the use condition of the further practical example according to this invention is generally shown. A board which is shown at the lower part in FIG. 6 is a large rectangle bed plate 71. On this bed plate 71, a large type hopper device 70 is fixed, as explained in FIG. 9.

Figure 7:
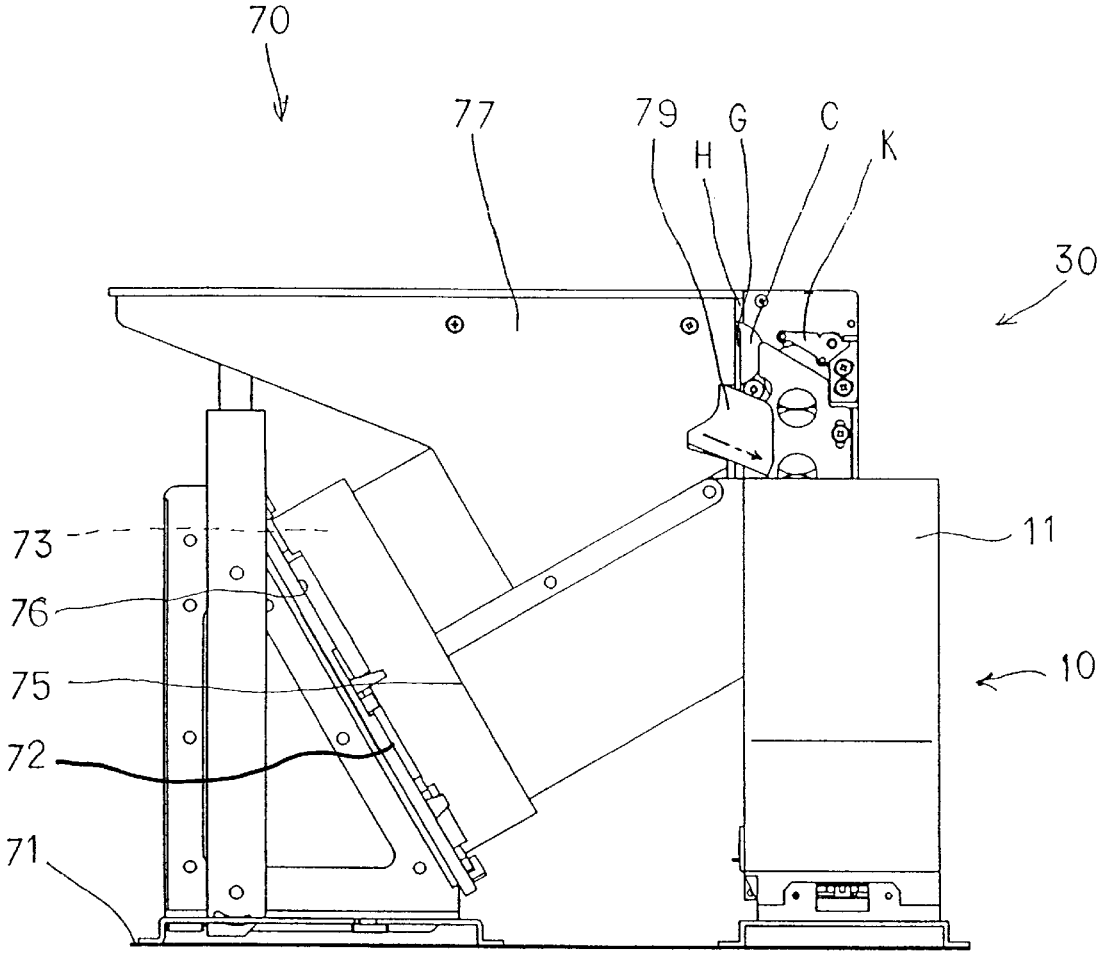
FIG. 7 is a summary side-view which is observed from the left side in FIG. 6.

The hopper device 70 has a little small square substrate 72 in an almost standing condition, intervening paired triangular legs (see FIG. 7). Then, on this upper surface of substrate 72, a rotating drum 73 with a hollow thick disk shape is freely rotatably arranged. In addition, tank 75 with a summary pot shape surrounds this rotating drum 73 and is fixed on substrate 72. The coin hopper device 70 has an exit 76 for releasing the coins in tank 75 to the outside (see FIG. 7). The rotating drum 73 is for driving away the coins in tank 75 to exit 76 one by one.

On the upper large opening of pot type tank 75, a large auxiliary tank 77 with an angle trumpet shape is arranged to be in communication. A shoot 79 for discharging coins is obliquely installed on one corner division of auxiliary tank 77. That is to say, when the coins in auxiliary tank 77 is approximately full, the coins are discharged to the outside from tube-like shoot 79. Near the lower or outside end of shoot 79, a tank 11 for storing coins of hopper device 10 which is mentioned earlier is arranged. Then, upper end division of above-mentioned escalator device 30 is placed near slot S which is formed at the opening of large tank 77.

Figure 8:
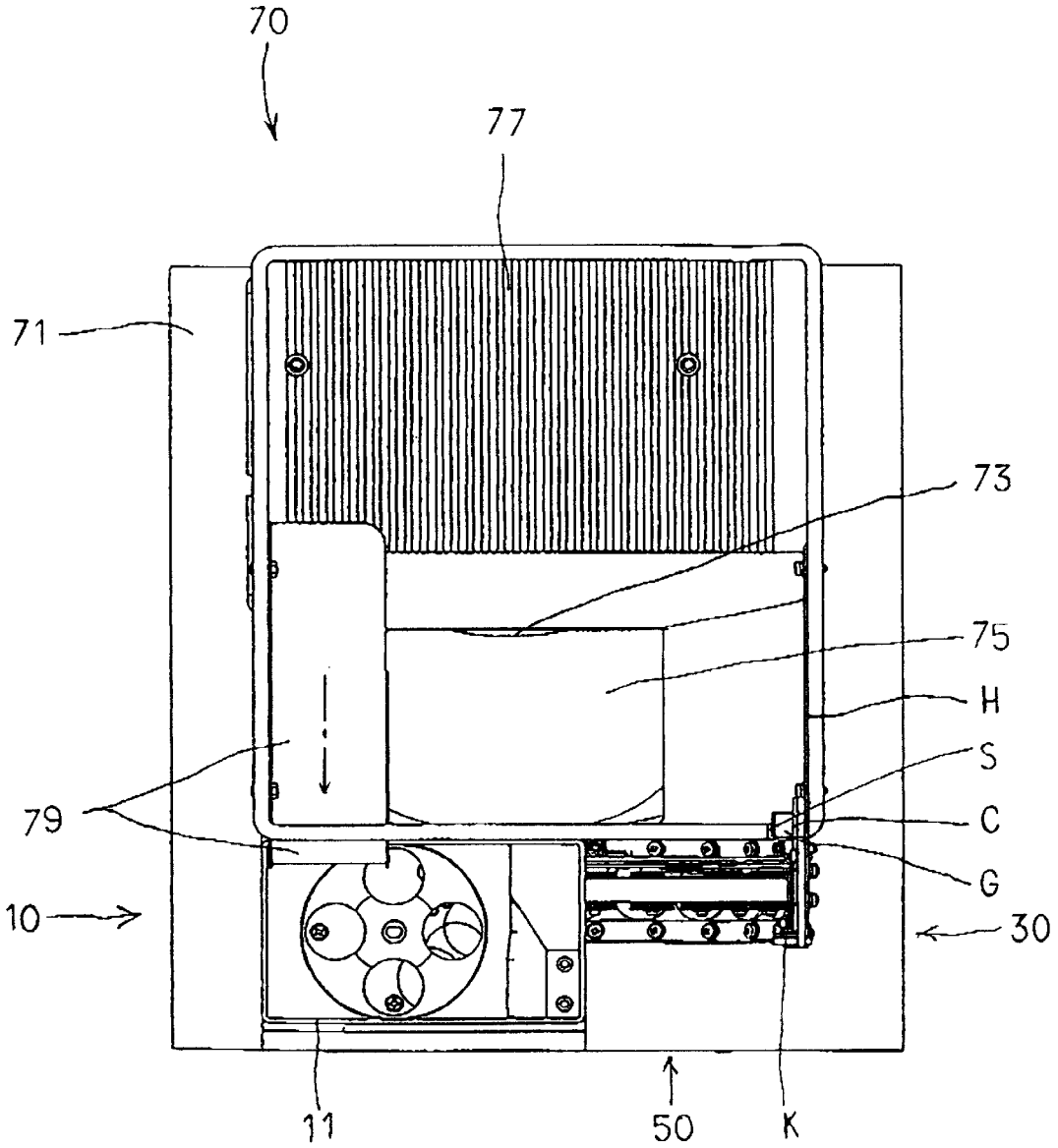
FIG. 8 is a summary plan view which is observed from the top of FIG. 6.

At the upper end division of escalator device 30, a horizontal arm H for mounting is fixed and U-type coin guide G. The escalator device 30 is arranged so that coin guide G may be located in slot S. The width of arm H which is a thin board is fixed on the opening in-wall of the large tank 77 (see FIG. 8). As described above, a coin circulation type hopper device is provided when the lifting style small hopper device is combined with the large hopper device 70. When the coins in large hopper device 70 overflow, the overflowed coins are stored in tank 11, intervening shoot 79.

The small hopper device 10 is driven, when the number of coins in large hopper device 70 decreases. As this result, intervening escalator device 30, the coins in tank 11 are supplemented into large hopper device 70. In other words, the coins which are sent from large hopper device 70 to the lifting style small hopper device are sent again or circulated to large hopper device 70.

As pointed out in the above description, this invention can miniaturize the escalator device by the adaption of simple features. This invention can convert the coin condition from a level posture to perpendicular posture by means of a small escalator device. In addition, the lifting style hopper device can be miniaturized, when the small hopper device is used. Furthermore, a circulation type hopper device can be completed, with a lifting style small hopper device of this invention combined with a large hopper device.

While specific embodiments of the invention have been shown and described in detail to illustrate the application of the principles of the invention, it will be understood that the invention may be embodied otherwise without departing from such principles.

What is claimed is:

1. A coin circulating hopper device, comprising:

an escalator device with a back plate with a curved surface for carrying a plurality of coins, arranged in a single row, from a plate bottom to a plate top, a pair of spacers respectively placed at each side on an upper surface of said back plate, a plurality of idlers freely rotatably arranged covering the back plate between the paired spacers, and a spring device for pressing said idlers to said back plate;

a small hopper with a tank and a rotatable disk for dispensing coins from the tank and positioning them for transport by said escalator device; and a large hopper with a discharge mechanism for discharging coins to said small hopper, said escalator device discharging coins from said small hopper to said large hopper.

2. A combination according to claim 1, further comprising an endless belt stretched on said plurality of idlers.

3. A combination according to claim 1, wherein said spring device has arms.

4. An escalator for coins comprising:

a back plate with a curved surface for carrying a plurality of coins, arranged in a single row, from a plate bottom to a plate top;

a pair of spacers respectively placed at each side on an upper surface of said back plate;

a mounting plate bridged between the paired spacers at the plate bottom;

a long arm freely pivoted on said mounting plate;

a large spring for pressing said long arm to said back plate;

a pair of short arms respectively pivoted freely at each end on said long arm;

a pair of small springs for pressing said short arms respectively, to said back plate;

a plurality of idlers freely pivoted on the paired short arms and arranged covering the back plate between the paired spacers;

an endless belt stretched on said plurality of idlers.

5. A device in accordance with claim 4, further comprising:

a hopper with a tank and a rotatable disk for dispensing coins from the tank and positioning them for transport by said escalator device.

6. An escalator device for a plurality of coins, the device comprising:

a back plate with a curved surface for supporting the plurality of coins, said back plate having a first and second end;

a support arm pivotally connected to said first end of said back plate, said support arm having first and second ends;

a first contact arm pivotally connected to said first end of said support arm;

a second contact arm pivotally connected to said second end of said support arm;

a belt rotatable around said first and second arms;

a spring biasing said arms and said belt against said curved surface of said back plate.

7. A device in accordance with claim 6, wherein:

a plurality of idlers are mounted on said first and second contact arms;

said belt passes around said plurality of idlers;

said spring includes a support spring biasing said support arm against said curved surface of said back;

said spring includes a first contact spring biasing said first contact arm against said curved surface of said back;

said spring includes a second contact spring biasing said second contact arm against said curved surface of said back.

8. A robot in accordance with claim 7, wherein:

said backplate includes opposite edges;

spacers are mounted on said opposite edges of said backplate and guide the coins between said opposite edges;

said belt is arranged between said spacers.

9. A device in accordance with claim 6, further comprising:

a hopper;

a rotatable disk in said hopper for dispensing coins from said hopper to said first end of said back plate between said curved surface and said belt.

* * * * *